United States Patent [19]

Leary et al.

[11] Patent Number: 4,547,659

[45] **Date of Patent: * Oct. 15, 1985**

[54] PTC HEATER ASSEMBLY

[75] Inventors: David F. Leary, Woodside; Alan Brigham, Sunnyvale, both of Calif.

[73] Assignee: Raychem Corporation, Menlo Park, Calif.

[ * ] Notice: The portion of the term of this patent subsequent to Jan. 10, 2001 has been disclaimed.

[21] Appl. No.: 558,631

[22] Filed: Dec. 5, 1983

Related U.S. Application Data

[63] Continuation of Ser. No. 216,952, Dec. 16, 1980, Pat. No. 4,425,497, which is a continuation of Ser. No. 67,309, Aug. 17, 1979, abandoned.

[51] Int. Cl.[4] ..... H05B 1/02

[52] U.S. Cl. ..... 219/544; 219/345; 219/353; 219/528; 219/540; 219/549; 174/52 PE; 338/22 R; 338/212

[58] Field of Search ..... 219/211, 212, 345, 353, 219/441, 528, 530, 540, 544, 549; 338/212, 22 R, 22 SD; 174/52 PE

[56] References Cited

U.S. PATENT DOCUMENTS

| | | | |
|---|---|---|---|
| 3,010,007 | 11/1961 | Theodore et al. | 219/544 X |
| 3,088,019 | 4/1963 | Crump | 219/528 X |
| 3,153,140 | 10/1964 | Theodore et al. | 219/549 |
| 3,271,638 | 9/1966 | Murad | 174/52 PE |
| 3,627,981 | 12/1971 | Kuhn | 219/212 |
| 3,657,518 | 4/1972 | Welsh et al. | 219/540 X |
| 3,748,439 | 7/1973 | Ting et al. | 219/353 |
| 3,824,328 | 7/1974 | Ting et al. | 174/52 PE |
| 3,858,144 | 12/1974 | Bedard et al. | 338/22 R |
| 3,859,504 | 1/1975 | Motokawa | 219/345 |
| 4,074,222 | 2/1978 | Kiyokawa et al. | 338/212 |
| 4,104,509 | 8/1978 | Van Bokestal et al. | 219/544 |
| 4,177,375 | 12/1979 | Meixner et al. | 219/441 |
| 4,242,573 | 12/1980 | Batliwalla | 219/528 |

FOREIGN PATENT DOCUMENTS

| | | |
|---|---|---|
| 2165943 | 12/1972 | France . |
| 2266416 | 3/1974 | France . |
| 2266418 | 3/1975 | France . |
| 2307430 | 4/1976 | France . |
| 2404983 | 9/1978 | France . |
| 774831 | 5/1957 | United Kingdom . |
| 1408765 | 10/1975 | United Kingdom . |
| 1496956 | 1/1978 | United Kingdom . |
| 1521460 | 8/1978 | United Kingdom . |
| 1540482 | 2/1979 | United Kingdom . |
| 2007478 | 5/1979 | United Kingdom . |

OTHER PUBLICATIONS

Raychem Corporation, the Chemelex Division, "Thermal Design Guide," (H 50190 505 B5 1/78).

*Primary Examiner*—Volodymyr Y. Mayewsky
*Attorney, Agent, or Firm*—Timothy H. P. Richardson; Herbert G. Burkard

[57] ABSTRACT

A PTC heater assembly comprises at least one PTC heater surrounded by an envelope of high thermal conductivity, thus greatly increasing the power output of the heater under operating conditions. In a preferred assembly a strip heater, comprising (i) an elongate strip of a conductive polymer PTC composition, (ii) electrodes embedded in said strip, and (iii) an insulating jacket, is sandwiched between a pair of metal, e.g. aluminum, sheets.

4 Claims, 6 Drawing Figures

PTC HEATER ASSEMBLY

CROSS-REFERENCE TO RELATED APPLICATIONS

This application is a continuation of copending Serial No. 216,952 filed Dec. 16, 1980, U.S. Pat. No. 4,425,497, which is itself a continuation of Serial No. 67,309 filed Aug. 17, 1979, now abandoned.

BACKGROUND OF THE INVENTION

1. Field of the Invention

This invention relates to electrical heaters comprising PTC elements.

2. Summary of the Prior Art

PTC compositions, i.e. compositions which exhibit positive temperature coefficients of resistance, are well known, and heaters and other electrical devices which comprise at least one PTC element (i.e. an element composed of a PTC composition) are also well known. Reference may be made for example to U.S. Pat. Nos. 2,978,665; 3,243,753; 3,351,882; 3,412,358; 3,413,442; 3,591,526; 3,673,121; 3,793,716; 3,823,217; 3,858,144; 3,861,029; 3,914,363 and 4,017,715; and U.S. Patent Office Defensive Publication No. T 905001. Reference may also be made to commonly assigned U.S. patent application Ser. Nos. 601,550 (now U.S. Pat. No. 4,188,276), 601,638 (now U.S. Pat. No. 4,177,376), 601,639 (now abandoned), 638,440 (and the CIP thereof Ser. No. 775,882), 732,792 (now abandoned), 750,149 (now abandoned), 873,876 now U.S. Pat. No. 4,246,468 and 965,345 now abandoned. The disclosure of each of these publications and applications is hereby incorporated by reference.

The PTC heaters which are most widely used in practice are strip heaters which comprise an elongate strip of a conductive polymer PTC composition, the strip having in contact therewith (generally embedded therein) two or more parallel electrodes whose ends can be connected to a source of electrical power, the strip and the electrodes being surrounded by an electrically insulating jacket. The strip heater is, for example, wound around a metal pipe which is to be maintained at a controlled elevated temperature, and the pipe and heater may be surrounded by a layer of thermal insulation. Reference may be made for example to the Thermal Design Guide published by the Chemelex Division of Raychem Corporation (H 50190 505 B5 1/78). Although such heaters have proved extremely useful, the active power output which can be obtained from such a heater is not as high as is desirable. Attempts to improve the active power output by varying the resistivity of the PTC composition (and therefore the resistance of the heater in a given geometry) give only a small increase in useful power output and involve other disadvantages, for example increased current inrush and/or shorter heater life. Strip heaters which have been used heretofore at normal supply voltages (generally 120 or 240 volts) have passive power ratings of 7 to 50 watts per foot and active power ratings of 4 to 10 watts per foot, with the ratio of passive power to active power being from 2:1 to 5:1. The terms "passive power rating" is used herein to denote a theoretical power output given by the term $V^2R_0$, where V is the nominal intended supply voltage and $R_0$ is the resistance of the heater at 70° F. The term "active power output" is the measured power output of the heater with one major surface thereof in contact with metal substrate which is at some temperature related to the intended use of the heater, for heaters for freeze protection for pipes, and with the heater powered at its normal operating voltage.

SUMMARY OF THE INVENTION

We have now surprisingly discovered that the active power output of a PTC heater can be vastly improved by substantially surrounding the heater with an envelope of high thermal conductivity which is in intimate thermal contact with the heater. Typically the heater is sandwiched between a pair of metal sheets. We have found that in this way the active power output of the heater can be increased at least 1.5 times and often at least doubled. While the reasons for this remarkable improvement are not well understood, it is clear that in combination with the PTC heater, the metal sheets (or the like), give an effect which is entirely different from the effect observed when metal fins or the like are combined with a conventional heater, which effect is merely to distribute the heat more efficiently in known manner, without affecting the thermal output of the heater. It is theorised that in at least some embodiments of the invention, one of the effects of the envelope is to provide more uniform generation of heat within the PTC element of the heater; in addition to providing an improvement in thermal output this can improve the useful life of the heater.

BRIEF DESCRIPTION OF THE DRAWINGS

The invention is illustrated in the accompanying drawings, in which.

DETAILED DESCRIPTION OF THE INVENTION

Figure 1:
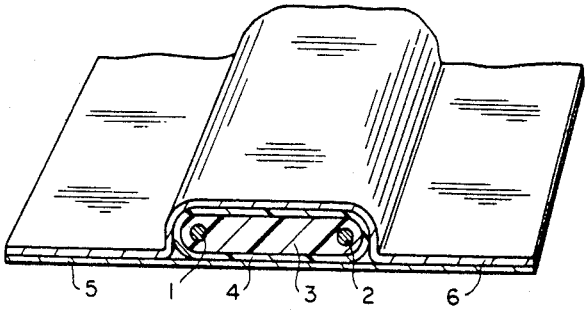
FIG. 1 is an isometric view, partly in cross-section, of a preferred heater assembly of the invention.

The invention is particularly useful for increasing the power output of PTC heaters which comprise (i) an elongate strip of a conductive polymer PTC composition (ii) two (or more) elongate, parallel electrodes in physical and electrical contact with said strip (e.g. wholly surrounded by said strip); and (iii) an electrically insulating jacket which surrounds said strip and said electrodes and which generally has a thickness of 8 to 25 mils;

and the invention will be chiefly described by reference to such heaters. It is to be understood, however, that the invention is useful with all types of PTC heaters, and that the electrically insulating jacket between the heater and the envelope need not be an integral part of the heater but may be provided between the two at the time of assembly.

The envelope surrounding the heater may be composed of any material having a suitable thermal conductivity, generally at least 0.1 Cal/cm. °C. sec., preferably at least 0.3 Cal/cm. °C. sec. Preferably the envelope is formed by a pair of elongate sheets with the heater sandwiched between them, the sheets contacting each other either side of the heater. The sheets are preferably 1 to 50 mils thick and composed of a material having a thermal conductivity of at least 0.3, for example aluminum sheets 3 to 8 mils thick. They may be secured together and/or to the heater by means of an adhesive, e.g. an epoxy adhesive.

It is important that the envelope and the PTC heater should be in intimate thermal contact, and the envelope preferably contacts (either directly or through an adhesive) a least the areas of the insulating jacket adjacent those parts of the heater in which heat is generated, for example, in the case of a strip heater as described above, between the electrodes. Preferably there are no voids between the envelope and the heater. It is preferred that the envelope should extend outwards from the PTC heater in the form of fins (or the like). Preferably the exposed surface area of the envelope is at least 1.5 times the surface area of the insulating jacket of the PTC heater, especially at least 2 times. The envelope may also serve to limit access of oxygen to the PTC composition as taught by Application Ser. No. 965,345 but this is not necessary to obtain increased power output.

Referring now to FIG. 1, this shows a PTC heater comprising electrodes 1 and 2 embedded in a strip 3 of a PTC conductive polymer composition which is surrounded by an insulating jacket 4. The heater is sandwiched between a pair of aluminum sheets 5 and 6 which are bonded to each other and to the heater by means of an adhesive (not shown).

The increased active power outputs which are obtained by this invention make it possible to use PTC strip heaters having higher passive power ratings, e/g/ 50–200 watts/ft. preferably 70–200 watts/ft., than conventional PTC strip heaters, which have passive power ratings of 7–50 watts/ft. For a given active power output, this means that the heater assemblies of the present invention, as compared to conventional PTC heaters, can be much less subject to the problem of current inrush.

The heater assemblies of the present invention can comprise two or more PTC heaters. The heaters may be spaced apart from each other and connected by an envelope which surrounds each of them, e.g. a plurality of parallel strip heaters sandwiched between a pair of metal sheets.

The invention is illustrated by the following Examples.

EXAMPLE 1

A heater assembly as shown in FIG. 1 was made using a PTC strip heater 20 inches long and about ½ inch wide and two sheets of aluminum each 0.008 inches thick, 2½ inches wide and 20 inches long. One surface of the assembly was covered with black adhesive tape. The assembly was then placed with its long axis parallel to a 0.83" diameter mandrel and bent around the mandrel into a partial cylinder, with the black surface outwards.

The assembly was used to preheat a cylindrical, 1" diameter, fluorescent light bulb, the PTC heater being connected to a 120 volt AC power supply of 120 volts alternating current. The temperature of the aluminum sheets varied by 5°–6° C. from the center to the outer edge. The active power output of the assembly was 13.8 watts/foot at 60° C. The active power output of the strip heater alone was 5.3 watts per foot at 60° C.

EXAMPLE 2

This example illustrates more uniform generation of heat in a PTC heater as a result of enveloping the heater in metal sheets.

Figure 2:
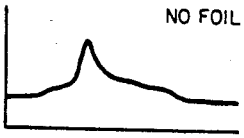
FIGS. 2 to 5 are thermographic images of PTC heaters with and without envelopes.

A PTC heater in the form of a sheet was prepared by laminating two expanded nickel electrodes, each one half inch thick and spaced three inches apart into the surface of a PTC sheet. The PTC sheet was 45 mils thick and about 5 inches long, and was composed of a dispersion of carbon black in low density polyethylene. The resistivity of the PTC sheet at 70° F. was 55 ohm-cm. The heater was powered at one watt per square inch and photographed using a Spectrotherm thermographic imager. The photograph is illustrated in FIG. 2. The heater was disconnected and allowed to cool.

Figure 3:
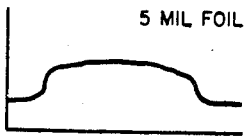

The PTC heater was enveloped between two sheets, 5 mils thick, of polyester resin insulation and then between two sheets of aluminum 5 mils thick. The outer surface of the aluminum sheets were painted black so that the emissivity of the aluminum was substantially the same as the emissivity of the heater itself and the same calibration of the thermographic imager could be used. The heater was powered at one watt per square inch and the Spectrotherm photograph was taken. The photograph is illustrated in FIG. 3, which shows more uniform generation of heat as compared to the heater alone as shown in FIG. 2.

Figure 4:
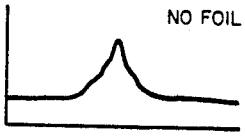
Figure 5:
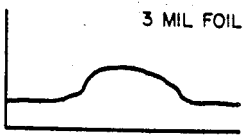

The procedure was repeated using a second PTC heater prepared as above but with the electrodes spaced one and a half inches apart. FIG. 4 illustrates the Spectrotherm photograph of the heater. The heater was enveloped with polyester sheets as above and then aluminum sheets 3 mils thick. FIG. 5 illustrates the Spectrotherm photograph of the assembly showing more uniform generation of heat as compared to the heater alone as shown in FIG. 4.

EXAMPLE 3

Figure 6:
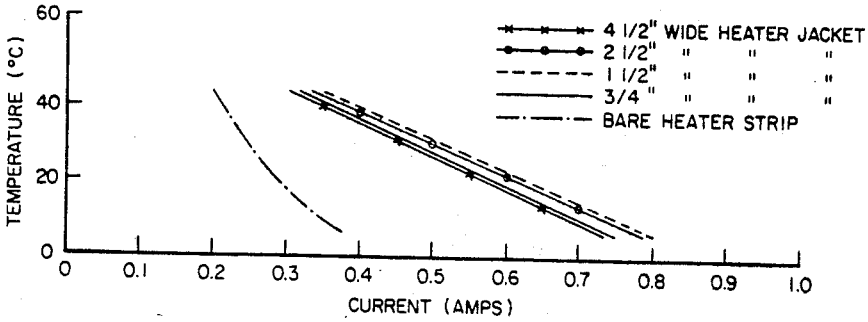
FIG. 6 shows the relationship between current and substrate temperature in the measurement of the active power outputs of the heater and heater assemblies described in Example 3.

The PTC heater used in this Example was a 24" length of a PTC strip heater 0.4" wide used as the heater component of a waterbed heater sold by Raychem Corporation and comprising two copper wire electrodes embedded in a strip of a PTC conductive polymer composition comprising a dispersion of carbon black in an ethylene/ethyl acrylate copolymer. The active power outputs of this heater, alone or as part of a heater assembly of this invention, were measured by securing the heater or heater assembly to an aluminum plate ½"×6"×24" and connecting the heater to a 120 volt AC power supply. In the heater assemblies tested in this Example, the heater was sandwiched between two identical aluminum sheets 24" long and 0.008" thick, and having widths of 4.5", 2.5", 1.5" and 0.75" respectively. FIG. 6 shows the relationship between the temperature of the plate and the current passing through the heater. The Table below shows the calculated active power output (current×applied voltage) of the heater when the plate is at 50° F. (10° C.).

TABLE

| Width of Metal Envelope | Active Power at 50° F. |
|---|---|
| none | 21 watts/ft. |
| 4.5 inch | 42.6 watts/ft. |
| 2.5 inch | 44.0 watts/ft. |
| 1.5 inch | 45.6 watts/ft. |

TABLE-continued

| Width of Metal Envelope | Active Power at 50° F. |
|---|---|
| 0.75 inch | 42.6 watts/ft. |

We claim:

1. A heater assembly which comprises (a) a PTC heater which has a passive power rating of 70 to 200 watts/foot and which comprises (i) an elongate strip of a conductive polymer PTC composition;

(ii) two elongate, parallel electrodes in physical and electrical contact with said strip; and (iii) an electrically insulating jacket which surrounds said strip and said electrodes; and (b) an envelope which substantially surrounds and is in intimate thermal contact with said PTC heater, which is electrically insulated from said elongate strip and said electrodes by said insulating jacket, and which is composed of a material having a thermal conductivity of at least 0.3 Cal/cm. °C. sec.

2. A heater assembly according to claim 1 wherein said heater assembly has an active power output at 50° F. which is at least 1.5 times the active power output at 50° F. of the PTC heater without the envelope.

3. A heater assembly according to claim 1 wherein said envelope is composed of a metal.

4. A heater assembly according to claim 3 wherein said metal is aluminum.

* * * * *